US008043782B2

(12) United States Patent
Jeong

(10) Patent No.: US 8,043,782 B2
(45) **Date of Patent: *Oct. 25, 2011**

(54) TONER FOR ELECTROPHOTOGRAPHY

(75) Inventor: Jae-hyeuk Jeong, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 951 days.

This patent is subject to a terminal disclaimer.

(21) Appl. No.: 12/010,036

(22) Filed: Jan. 18, 2008

(65) Prior Publication Data

US 2008/0176153 A1 Jul. 24, 2008

(30) Foreign Application Priority Data

Jan. 22, 2007 (KR) ..... 10-2007-0006694

(51) Int. Cl.
*G03G 9/00* (2006.01)

(52) U.S. Cl. ..... 430/111.4; 430/123.5; 430/123.53; 430/123.54

(58) Field of Classification Search ..... 430/111.4, 430/123.5, 123.53, 123.54
See application file for complete search history.

(56) References Cited

U.S. PATENT DOCUMENTS 7,927,776 B2 * 4/2011 Jeong et al. ..... 430/111.4
7,935,470 B2 * 5/2011 Jeong et al. ..... 430/111.4

* cited by examiner

*Primary Examiner* — Mark Chapman
(74) *Attorney, Agent, or Firm* — Roylance, Abrams, Berdo & Goodman, L.L.P.

(57) ABSTRACT

A toner for electrophotography is provided including a binder resin, a coloring agent, a charge controlling agent, and a releasing agent, wherein when the temperature of the toner is in the range from a temperature 40° C. lower than a fixing temperature of the toner to a temperature 10° C. lower than the fixing temperature of the toner, the D Log η*/DT absolute value is 0.02 or more, when the temperature of the toner is in the range from a temperature 10° C. lower than the fixing temperature of the toner to a temperature 10° C. higher than the fixing temperature of the toner, the D Log η*/DT absolute value is 0.005 or less, and the complex viscosity (η*) of the toner at a fixing temperature and an angular velocity of a fixing heat roller is in the range from about $5.0\times10^1$ Pa·s to $1.0\times10^2$ Pa·s. The toner has excellent fixing properties so that the quality of an image can be stabilized, and cause less contamination.

9 Claims, 4 Drawing Sheets

TONER FOR ELECTROPHOTOGRAPHY

CROSS-REFERENCE TO RELATED PATENT APPLICATIONS

This application claims the benefit of Korean Patent Application No. 10-2007-0006694, filed on Jan. 22, 2007, in the Korean Intellectual Property Office, the disclosure of which is hereby incorporated by reference in its entirety.

BACKGROUND OF THE INVENTION

1. Field of the Invention

The present invention relates to a toner for electrophotography. More particularly, the invention relates to a toner for electrophotography which has rheological properties including excellent fixing properties and which causes less contamination when the toner is fixed.

2. Description of the Related Art

In imaging apparatuses, such as electrophotographic devices or electrostatic recording devices, an electrostatic latent image is formed on a uniformly charged photoreceptor through an image exposing process, a toner is attached to the electrostatic latent image to form a tone image, and then the tone image is transferred to a transfer material, such as a transfer sheet. Subsequently, the tone image which is not yet fixed is fixed on the transfer material by a heating process, a compressing process, a solvent evaporating process, or the like. In the fixing process, in general, the transfer material to which the tone image is transferred passes through a dwell roll and a pressing roll, and thus, the toner is heated and compressed to be melted on the transfer material. At this time, the toner that is to be fixed is fixed on the transfer material according to fixing conditions and a stable image is formed.

In a heat fixing method using a heating roller or film, excellent heat efficiency is required to hot-melt adhere the tone image to a dwell sheet when the surface of the heating roller or film contacts the toner image on the dwell sheet. In addition, a high thermal capacity of a heat fixing unit is also required to prevent fixing failure due to the passage of the dwell sheet and low-temperature fixing. Accordingly, there is a need to improve the properties of a toner, specifically the low-temperature fixing properties of a toner in order to realize low electric power consumption with excellent fixing properties.

For example, in a fixing process of a pressure-heat fixing method, the surface of a high-temperature dwell roller and the tone image are contacted with each other in a melted phase under pressure, so that the toner is transferred and attached to the surface of the high-temperature dwell roller, and then the toner is transferred again to the subsequent dwell sheet so that the dwell sheet is contaminated, which is called an offset phenomenon. The offset phenomenon is heavily affected by fixing speed and temperature. In general, when the fixing speed is low, the surface temperature of a dwell roller is set to low. On the other hand, when the fixing speed is high, the surface temperature of a dwell roller is set to high. Such adjustments are required since there is a need to provide a constant heat capacity to the toner image in order to fix the tone image independently from the fixing speed.

The problem can be solved by increasing the fixing temperature when the fixing speed is high to easily fix the toner. In this method, the temperature of the heating roller can be decreased and high-temperature offset phenomenon at the most upper portion of the toner layer can be prevented. However, the method can cause several problems. For example, a winding offset phenomenon wherein a dwell sheet may surround the dwell roller when a very high shear force is applied to the toner layer may occur, and a separation unit that separates the dwell sheet from the dwell roller may leave an impression in a fixed image.

Korean Registered Patent No. 138,583, Korean Laid-open Patent Publication No. 2001-083034, and Korean Laid-open Patent Publication No. 1999-063467 disclose electrophotostatic toners having rheological properties, but do not disclose a way of obtaining excellent fixing properties and preventing the offset phenomenon at the same time. Accordingly, with respect to the heat transfer phenomenon and rheological properties of the toner, there is a need to develop a technique capable of improving fixing properties of the toner according to heat and pressure and preventing contamination.

SUMMARY OF THE INVENTION

The present invention provides a toner for electrophotography which has rheological properties including fixing properties and causes less contamination when the toner is fixed.

According to an aspect of the present invention, a toner is provided for electrophotography comprising a binder resin, a coloring agent, a charge controlling agent, and a releasing agent, wherein when the temperature of the toner is in the range from a temperature 40° C. lower than a fixing temperature of the toner to a temperature 10° C. lower than the fixing temperature of the toner, the D Log $\eta^*$/DT absolute value is 0.02 or more, when the temperature of the toner is in the range from a temperature 10° C. lower than the fixing temperature of the toner to a temperature 10° C. higher than the fixing temperature of the toner, the D Log $\eta^*$/DT absolute value is 0.005 or less, and the complex viscosity ($\eta^*$) of the toner at the fixing temperature and an angular velocity of a fixing heat roller is in the range from about $5.0\times10^1$ Pa·s to $1.0\times10^2$ Pa·s.

According to the present invention, the toner can obtain excellent fixing properties so that the quality of an image is stabilized, and causes less contamination.

These and other aspects of the invention will become apparent from the following detailed description of the invention which taken in conjunction with the drawings disclose various embodiments of the invention.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
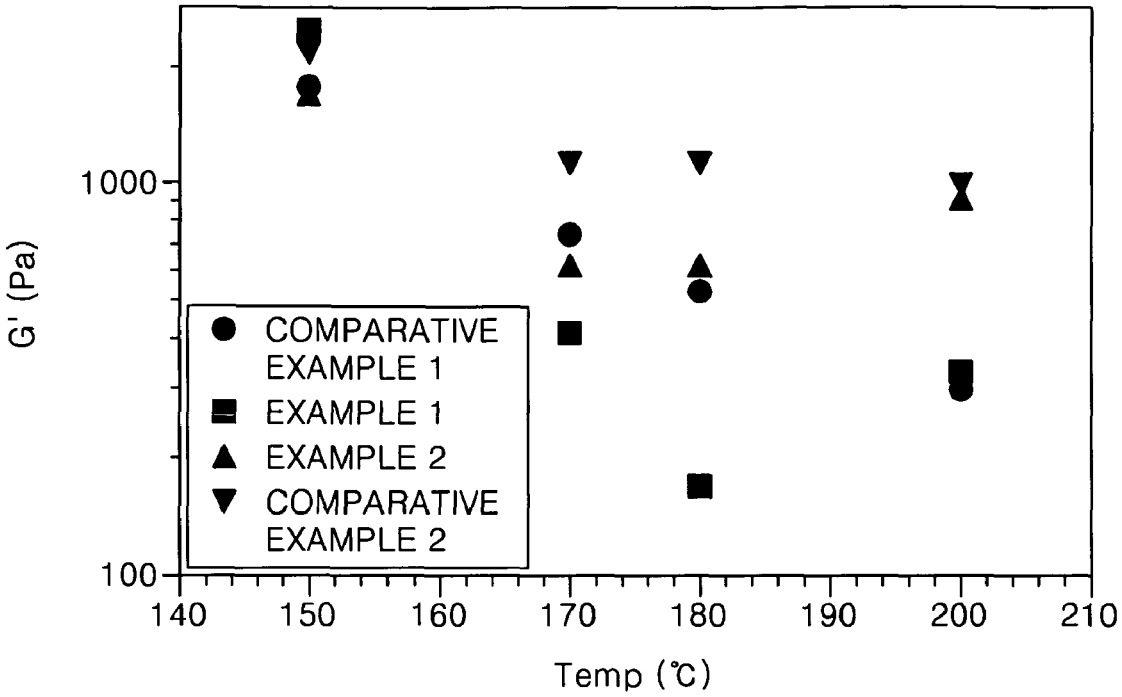
FIG. 1 is a graph of a storage elastic modulus (G') of a toner according to an embodiment of the present invention.

The present invention will now be described more fully with reference to the accompanying drawings, in which exemplary embodiments of the invention are shown.

According to the present invention, a toner for electrophotography including a binder resin, a coloring agent, a charge controlling agent, and a releasing agent is characterized in that when the temperature of the toner is in the range from a temperature 40° C. lower than a fixing temperature of the toner to a temperature 10° C. lower than the fixing temperature of the toner, the D Log η*/DT absolute value is about 0.02 or more, when the temperature of the toner is in the range from a temperature 10° C. lower than the fixing temperature of the toner to a temperature 10° C. higher than the fixing temperature of the toner, the D Log η*/DT absolute value is about 0.005 or less, and the complex viscosity (η*) of the toner at a fixing temperature and an angular velocity of a fixing heat roller is in the range from about $5.0\times10^1$ Pa·s to $1.0\times10^2$ Pa·s. The temperature dependency with respect to viscosity is given by D Log η*/DT where D denotes a differential and T denotes a temperature.

When the temperature of the toner is in the range from a temperature 40° C. lower than the fixing temperature of the toner to a temperature 10° C. lower than the fixing temperature of the toner, the D Log η*/DT absolute value may be about 0.02 or more, specifically in the range from about 0.02 to 0.05. When the D Log η*/DT absolute value is less than 0.02, a change of viscosity with respect to the temperature is small and thus the toner has sufficient properties. However, even with sufficient fixing properties, the toner may have poor low-temperature mechanical properties in a developing unit. In addition, even when the toner has sufficient low-temperature mechanical properties in the developing unit because of a small change in viscosity with respect to temperature, the toner has insufficient intensity. On the other hand, when the D Log η*/DT absolute value is too large, the change of viscosity with respect to temperature is too large and thus, a sustainable and stable image according to control of the dwell device cannot be obtained. When the temperature of the toner is in the range from a temperature 10° C. lower than the fixing temperature of the toner to a temperature 10° C. higher than the fixing temperature of the toner, the D Log η*/DT absolute value may be about 0.005 or less, specifically in the range from about 0.001 to 0.005. When the D Log η*/DT absolute value is larger than 0.005, viscosity is unstable with respect to time so that the fixing temperature range, that is, a dwell window is reduced, and thus contamination may occur or an unstable image may be formed.

In this regard, according to the present invention, the fixing temperature of the toner may be in the range of 160° C. to 200° C.

The complex viscosity may be given by the following formula:

$$\text{complex viscosity } (\eta)=(G'^2+G''^2)^{1/2}/w.$$

where G': storage elastic modulus (Pa), G": loss elastic modulus (Pa), and w: angular velocity (rad/s)

When a complex viscosity (η) is less than $5.0\times10^1$ Pa·s, the binder resin itself has too low a cohesive force, and thus, an offset phenomenon may occur at high temperature. On the other hand, when the complex viscosity (η) is greater than $1.0\times10^2$ Pa·s, the cohesive force of the binder resin is too high that surface grossness of a dwell image and sufficient dwell intensity cannot be obtained.

In the current embodiment, a complex viscosity may be measured at an angular speed of about 5 to 10 rad/s of the fixing heat roller. Dynamic viscoelasticity may be measured using a temperature dispersion measuring method in which a sine wave vibration method is used in a vibration frequency from about 5 to 10 rad/s, using an ARES measuring device produced by Rheometric Scientific Co.

A stress relaxation refers to a force that is required to prevent a decrease of a stain over time when the strain is applied to a toner. The stress relaxation also refers to a change of elasticity with respect to the dwell time of the toner in a dwell device.

The stress relaxation is used to identify a change of viscoelasticity with respect to time according to fixing conditions even when the viscosity is sufficient, since fixing conditions are dependent on physical properties a very short time before the toner has stabilized viscoelasticity, as well as on the viscosity measured when the toner shows a stable viscoelasticity after a predetermined time period.

An activation energy is a degree of sensitiveness of a change in viscosity with respect to temperature, and can be referred to prepare a desired toner. According to the present invention, when D Log η*/DT is less than 0.02, a change in viscosity with respect to temperature is too small. Therefore, when the toner has low viscosity, the tone may have small powder strength; on the other hand, when the toner has high viscosity, the toner has sufficient fixing strength. When D Log η*/DT is more than 0.05, the degree of sensitiveness of a change in viscosity with respect to temperature is high, powder/liquid has sufficient behavior, but a proper viscosity dependant on temperature and other rheological properties are not desired.

According to an embodiment of the present invention, even when a toner has a proper range of viscosity, stress relaxation during a dwell time at a temperature 10° C. lower than the toner fixing temperature may be in the range of about 300 to 1,000 Pa·s. When the stress relaxation is less than 300 Pa·s, the cohesive force of the toner in liquid phase is low so that contamination occurs. On the other hand, when the stress relaxation is higher than 1,000 Pa·s, the elastic force of the toner is relatively high.

A storage elastic modulus (G') relates to elasticity of a toner, and a loss elastic modulus (G") relates to plasticity of the toner. When the storage elastic modulus increases, a degree of elasticity of the toner may increase. On the other hand, when the loss elastic modulus increases, a degree of plasticity of the toner may increase. Accordingly, a dwell image having sufficient glossiness can be obtained by adjusting the ratio of elasticity to plasticity of the toner in a dwell process.

A loss tangent (tan δ) may be given by loss elastic modulus (G")/storage elastic modulus (G'). A maximum allowable range of tan δ with respect to contamination is greater when the viscosity of the toner is sufficiently high compared to when the viscosity of the toner is low. In addition, when the viscosity of the toner is high and the tan δ is high, fixing properties are improved.

When the tan δ is greater than 1 at a temperature ranging from 20° C. lower than the toner fixing temperature to the toner fixing temperature, elastic properties of the toner deteriorate but viscosity of the toner is relatively high, so that fixing properties of the toner may improve. However, when the fixing temperature of the toner is high and the viscosity of the toner is relatively low, and the tan δ is larger than 1, elastic properties of the toner may be decreased and thus contamination may occur.

When the toner has low elastic properties and high plasticity properties, separation of a roller from the toner due to elasticity may not occur and thus, contamination may occur or the viscosity of the toner itself may decrease. As a result, the adhesive force between sheets, intensity of the toner, and an adhesive force of the toner with respect to H/R may be unbalanced.

The toner forms an image through charging, exposing, developing, transferring, dwell, cleaning, and charge removing processes. Physical properties required to the toner can be determined in the developing process before the dwell process.

A binder resin which is used in the toner for electrophotography according to the present invention may be appropriately determined to obtain such properties of the toner which have been described above. That is, the D Log η*/DT absolute value of the binder resin may be about 0.002 smaller than that of a final toner, and the complex viscosity of the binder resin may be about 30 to 40 Pa*s smaller than that of a final toner.

Specifically, the final toner can have proper D Log η*/DT and proper complex viscosity by controlling the weight average molecular weight, the molecular weight distribution, and Gel % (insoluble component) of the binder resin.

The complex viscosity of the binder resin is dependent upon the weight average molecular weight of the binder resin. The weight average molecular weight of the binder resin may be in the range of 50,000 to 100,000, specifically in the range of 80,000 to 100,000. When the weight average molecular weight of the binder resin is less than 50,000, the viscosity at a specific temperature is too low, on the other hand, when the weight average molecular weight of the binder resin is greater than 100,000, the viscosity at the specific temperature is too high. In this regard, the specific temperature refers to a temperature in a temperature range in which the toner is affected when it passes thorough a dwell device. Specifically, such temperature range may be in the range of a temperature 40° C. lower than the fixing temperature of the toner to a temperature 10° C. higher than the fixing temperature of the toner The temperature dependency of viscosity, that is, D Log η*/DT is dependent upon the molecular weight distribution and Gel % of the binder resin. The molecular weight distribution of the binder resin may be in the range of 10 to 25, specifically, 15 to 20, and Gel % (insoluble component) of the binder resin may be in the range of 3 to 10%, specifically in the range of 3 to 5%.

When the molecular weight distribution of the binder resin is less than 10, viscosity is more dependent upon temperature but viscosity at high temperature becomes unstable. Therefore, the appropriate fixing temperature range may be narrowed. On the other hand, when the molecular weight distribution of the binder resin is greater than 25, viscosity is less dependent upon temperature and thus proper fixing properties and proper glossiness cannot be obtained. Also, when Gel % (insoluble component) is less than 3%, viscosity at high temperature becomes unstable, on the other hand, when Gel % (insoluble component) is greater than 10%, dispersability of additives with respect to the binder resin can be degraded.

The binder resin used in a developing toner according to the present invention can be selected from various kinds of resins. For example, the binder resin can be a styrene-based copolymer, such as polystyrene, poly-P-chlorostyrene, poly-α-methylstyrene, styrene-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-propyl acrylate copolymer, styrene-butyl acrylate copolymer, styrene-octyl acrylate copolymer, styrene-methyl methacrylate copolymer, styrene-ethyl methacrylate copolymer, styrene-propyl methacrylate copolymer, styrene-butyl methacrylate copolymer, styrene-α-chloromethyl methacrylate copolymer, styrene-acrylonitril copolymer, styrene-vinylmethylether copolymer, styrene-vinylethylether copolymer, styrene-vinylethylketone copolymer, styrene-butadiene copolymer, styrene-acrylonitril-inden copolymer, styrene-maleic acid copolymer, styrene-ester maleate, or the like; polymethylmethacrylate, polyethylmethacrylate, polybutylmethacrylate, or a copolymer thereof; polyvinylchloride; polyvinylacetate; polyethylene; polypropylene; polyester; polyurethane; polyamide; epoxy resin; polyvinylbutyral resin; rosin; modified rosin; terpene resin; phenol resin; aliphatic or alicyclic hydrocarbon resins; aromatic-based petroleum resin; chlorinated paraffin; paraffin wax; or a combination thereof. Specifically, the polyester-based resin is suitable for a color developing agent due to its excellent dwell and transparent properties.

Also, additives, such as a coloring agent, a charge controlling agent, a releasing agent, or an externally added additive, which will be described in detail later, are added to the binder resin, and the resultant mixture is stirred in an extruder and a final toner is prepared. Properties of the toner may vary according to those additives.

As for a black toner, the coloring agent can be carbon black or aniline black. The toner according to the current embodiment is a non-magnetic toner and thus, is suitable for color toners. As for a color toner, a black coloring agent is carbon black, and color coloring agents are yellow, magenta, and cyan coloring agent.

The yellow coloring agent may be a condensed nitrogen compound, isoindolinone compound, anthraquinone compound, azo metal complex, or allyl imide compound. For example, the yellow coloring agent can be C.I. pigment yellow 12, 13, 14, 17, 62, 74, 83, 93, 94, 95, 109, 110, 111, 128, 129, 147, 168, or 180.

The magenta coloring agent may be a condensed nitrogen compound, anthraquinone, a quinacridone compound, a basic dye late compound, a naphthol compound, a benzo imidazol compound, a thioindigo compound, or a perfyene compound. For example, the magenta coloring agent can be C.I. pigment red 2, 3, 5, 6, 7, 23, 48:2, 48:3, 48:4, 57:1, 81:1, 122, 144, 146, 166, 169, 177, 184, 185, 202, 206, 220, 221, or 254.

The cyan coloring agent may be a copper phthalocyanine compound or a derivative thereof, an anthraquine compound, or a basic dye late compound. For example, the cyan coloring agent can be C.I. pigment blue 1, 7, 15, 15:1, 15:2, 15:3, 15:4, 60, 62, or 66.

These coloring agents can be used alone or a combination of at least two kinds of compounds, and selected in consideration of desired color, saturation, brightness, an anti-weathering property, or a dispersing property in the toner.

The amount of the coloring agent may be in the range from about 0.1 to 20 parts by weight based on 100 parts by weight of the binder resin. The amount of the coloring agent can be determined to obtain sufficient coloring effects on the toner. When the amount the coloring agent is less than 0.1 parts by weight based on 100 parts by weight of the binder resin, the sufficient coloring effect cannot be obtained. On the other hand, when the amount the coloring agent is greater than 20 parts by weight based on 100 parts by weight of the binder resin, the manufacturing costs for the toner are high and sufficient friction charge cannot be obtained.

The charge controlling agent may be selected from a metal, such as zinc or aluminum, containing salicylic acid compound, a boron complex of bis diphenyl glycolic acid, and silicate. Specifically, the charge controlling agent can be dialkyl salicylic acid zinc, boro bis(1,1-diphenyl-1-oxoacetyl potassium salt), or the like.

In general, the charge controlling agent may be in the range of 0.5 to 1.5 parts by weight, specifically in the range of 0.8 to 1.2 parts by weight, based on 100 parts by weight of the binder resin. When the amount of the charge controlling agent is less than 0.5 parts by weight, the charge amount may have a large deviation with respect to ambient conditions. On the other hand, when the amount of the charge controlling agent is more than 1.5 parts by weight, the charge amount may not be proper and thus, an image obtained through developing and charging processes may not be uniform.

A releasing agent can be used to prepare a toner composition having proper viscosity and releasing properties in the dwell process. A releasing agent according to an embodiment of the present invention can be, but is not limited to, polyethylene-based wax, polypropylene-based wax, silicon wax, paraffin-based wax, ester-based wax, carnuba wax, or metallocene wax. The melting point of the releasing agent may be in the range from about 50 to about 150° C. The releasing agent is physically adhesive to particles of the toner, but is not covalently bonded to particles of the toner. The releasing agent allows a toner to be fixed on a final image receptor at low temperature and to have excellent durability and excellent abrasion resistance.

The amount of the releasing agent may be in the range of 1.5 to 3 parts by weight, specifically, 2 to 2.5 parts by weight, based on 100 parts by weight of the binder resin. When the amount of the releasing agent is less than 1.5 parts by weight, fixing properties may be degraded and the fixing temperature range may be narrowed. On the other hand, when the amount of the releasing agent is more than 3 parts by weight, storage-abitliy may be degraded.

The externally added additive can be silica or $TiO_2$. The amount of the externally added additive may be in the range of 1.5 to 4 parts by weight, specifically 2 to 3 parts by weight, based on 100 parts by weight of an externally added additive-free toner. When the amount of the externally added additive is less than 1.5 parts by weight, toner particles are gathered due to a cohesive force, which is a caking phenomena (toner particles are attached to each other), and the charge amount is unstable. On the other hand, when the amount of the externally added additive is greater than 4 parts by weight, an excessive amount of the externally added additive may contaminate a roller.

According to an embodiment of the present invention, an imaging method including forming a visible image by attaching a toner to the surface of a photoreceptor on which an electrostatic latent image is formed and transferring the visible image to a transfer material according to an embodiment of the present invention utilizes a toner which includes a binder resin, a coloring agent, a charge controlling agent, and a releasing agent, in which when the temperature of the toner is in the range from a temperature 40° C. lower than a fixing temperature of the toner to a temperature 10° C. lower than the fixing temperature of the toner, the D Log $\eta^*$/DT absolute value is 0.02 or more, when the temperature of the toner is in the range from a temperature 10° C. lower than the fixing temperature of the toner to a temperature 10° C. higher than the fixing temperature of the toner, the D Log $\eta^*$/DT absolute value is 0.005 or less, and the complex viscosity ($\eta^*$) of the toner at a fixing temperature and an angular velocity of a fixing heat roller is in the range from $5.0\times10^1$ Pa·s to $1.0\times10^2$ Pa·s.

Typically, an electrophotographic imaging process includes charging, exposing, developing, transferring, fixing, cleaning, and charge removing processes to form an image on a receiving structure.

In a charging process, typically, a photoreceptor is coated with a negative charge or a positive charge by a corona or a charging roller. In an exposing process, the charged surface of a photoreceptor is selectively discharged to form a latent image using an imagewise manner in which the arrangement of an optical system, typically a laser scanner or diode, corresponds to a target image that is to be formed on a final image receptor. The electromagnetic irradiation referred to as the term "light" can be infrared irradiation, visible light irradiation, or ultraviolet irradiation.

In a developing process, toner particles having sufficient polarity contact the latent image on the photoreceptor, and an electrically-biased developer having the same potential polarity as the toner is used. Toner particles move to the photoreceptor and are selectively attached to the latent image by an electrostatic force so that a toner image is formed on the photoreceptor.

In a transferring process, the toner image is transferred from the photoreceptor to the final image receptor. In some cases, an intermediate transferring element is used during the latter part of the transferring process of the toner image from the photoreceptor to the final image receptor.

In a dwell process, the toner image on the final image receptor is heated so that toner particles are softened or melted to be fixed on a final receptor. Alternatively, the toner image is fixed on the final receptor under high pressure and heating or under high pressure alone.

In a cleaning process, a residual toner on the photoreceptor is removed. In a charge removing process, charges of the photoreceptor are exposed to light having a specific wavelength band so that the charges are uniformly reduced to a low value. Therefore, the residual of the latent image is removed and a photoreceptor is prepared for the subsequent imaging cycle.

According to an embodiment of the present invention, an imaging apparatus for forming an image includes: an organic photoreceptor; a unit charging a surface of the organic photoreceptor; a unit forming an electrostatic latent image on a surface of the organic photoreceptor; a unit containing toner; a unit supplying the toner to the surface of the organic photoreceptor to develop the electrostatic latent image on the surface of the organic photoreceptor into a toner image; and a unit transferring the toner image from the surface of the organic photoreceptor onto a transfer medium, wherein the toner is a toner for electrophotography according to the invention, in which the toner includes a binder resin, a coloring agent, a charge controlling agent, and a releasing agent and is characterized in that when the temperature of the toner is in the range from a temperature 40° C. lower than a fixing temperature of the toner to a temperature 10° C. lower than the fixing temperature of the toner, the D Log $\eta^*$/DT absolute value is 0.02 or more, when the temperature of the toner is in the range from a temperature 10° C. lower than the fixing temperature of the toner to a temperature 10° C. higher than the fixing temperature of the toner, the D Log $\eta^*$/DT absolute value is 0.005 or less, and the complex viscosity ($\eta^*$) of the toner at a fixing temperature and an angular velocity of a fixing heat roller is in the range from $5.0\times10^1$ Pa·s to $1.0\times10^2$ Pa·s.

Figure 6:
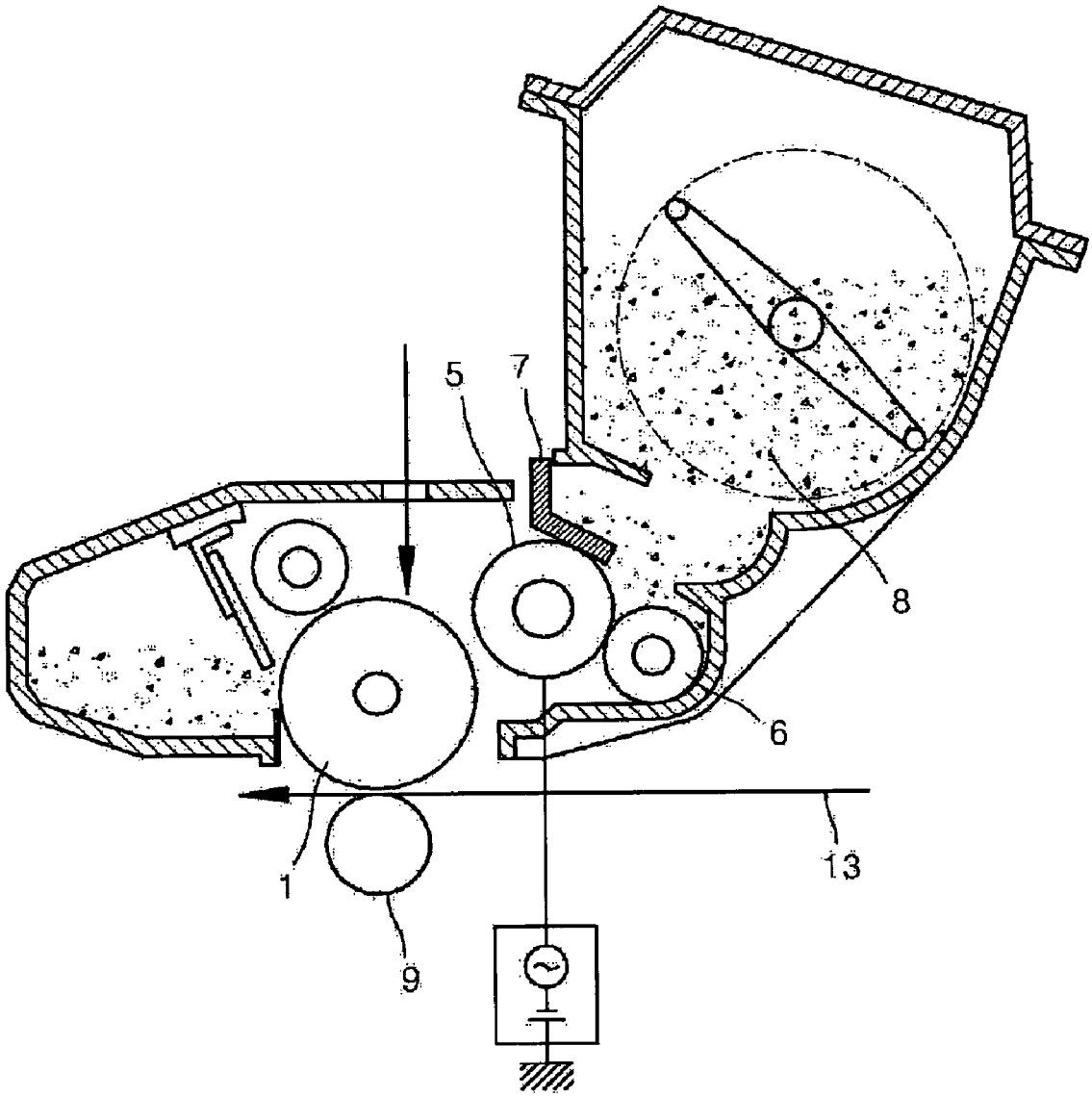
FIG. 6 is a view of an imaging apparatus including a toner prepared according to an embodiment of the present invention.

FIG. 6 is a sectional view of a non-contact development type-imaging apparatus including a toner prepared according to an embodiment of the present invention. An operation method of the non-contact development type-imaging apparatus will now be described in detail.

A developer 8 that is a non-magnetic one component developing agent is transferred to a development roller 5 by a supply roller 6 formed of a carbonaceous unit, such as polyurethane foam or sponge. The developer 8 transferred to the development roller 5 arrives at a contact portion between a developer control blade 7 and the development roller 5 according to a rotation of the development roller 5. The developer control blade 7 may be formed of a carbonaceous unit, such as metal or rubber. When the developer 8 passes through the contact portion between the developer control blade 7 and the development roller 5, the developer 8 is formed into a thin layer, and sufficiently charged. The thin layer of the developer 8 is transferred by the development roller 5 to a development area in which the developer 8 is developed according to the electrostatic image on a photoreceptor 1 that is a latent image carrier.

The development roller 5 faces the photoreceptor 1, and is separated a distance from the photoreceptor 1. The development roller 5 rotates in an anti-clockwise direction, and the photoreceptor 1 rotates in a clockwise direction. The developer 8 transferred to the development area is developed according to the electrostatic image on the photoreceptor 1 by an electric force generated due to a potential difference between the DC-folded AC voltage applied to the development roller 5 and the potential of the latent image of the photoreceptor 1.

The developer 8 developed on the photoreceptor 1 arrives at a transfer unit 9 according to a rotation of the photoreceptor 1. The developer developed on the photoreceptor 1 is transferred to a print sheet 13 by a corona discharge or the transfer unit 9 applied with high voltage having polarity opposite to the developer 8 in a roller shape when the print sheet 13 passes, thereby forming an image.

The image transferred to the print sheet 13 passes through a dwell device (not shown) having high temperature and high pressure, and thus the developer 8 is melted on the print sheet 13 and an image is fixed. Meanwhile, un-developed residual developer on the development roller 5 is collected by the supply roller 6 contacting the development roller 5. These processes described above are repeatedly performed.

The present invention will be described in further detail with reference to the following examples. These examples are for illustrative purposes only and are not intended to limit the scope of the present invention.

Example 1

100 parts by weight of a polyester-based resin having an acid value of about 1 (Samyang Co., ML125, THF-insoluble component: 3%, weight average molecular weight of about 80,000, and molecular weight distribution (MWD) of 15) was used as a binder resin. Then, 2.3 parts by weight of Carnuba Wax (produced by Japanese Kato Co.) acting as a releasing agent, 1 part by weight of LR-147 (produced by Carlit Co.) acting as a charge controlling agent, 1 part by weight of Mogul-L (produced by Cabot Co.) acting as a coloring agent, and about 1 parts by weight of Silica RY150 (produced by Aerosil Co.), and about 0.5 parts by weight of RX300 (produced by Aerosil Co.) and about 0.8 parts by weight of TiO2 MPT313 (produced by ISK Co.) acting as an inorganic externally added additive were added to the binder resin to completely prepare a toner.

With respect to complex viscosity, a D Log η*/DT value in the temperature range from fixing temperature −40° C. to fixing temperature −10° C. with respect to the fixing temperature was 0.03, and a D Log η*/DT value in the temperature range from fixing temperature −10° C. to fixing temperature +10° C. with respect to the fixing temperature is −0.001.

Example 2

A toner was prepared in the same manner as in Example 1, except that 100 parts by weight of a polyester-based resin having an acid value of about 1 (Samyang Co., ML130, THF-insoluble component: 3%, weight average molecular weight of about 100,000, and MWD of 20) was used as the binder resin.

With respect to the complex viscosity, a D Log η*/DT value in the temperature range from fixing temperature −40° C. to fixing temperature −10° C. with respect to the fixing temperature was −0.02, and a D Log η*/DT value in the temperature range from fixing temperature −10° C. to fixing temperature +10° C. with respect to the fixing temperature is −0.002.

Comparative Example 1

A toner was prepared in the same manner as in Example 1, except that 100 parts by weight of a polyester-based resin having an acid value of about 1 (Samyang Co., MH121, THF-insoluble component: 1%, weight average molecular weight of about 40,000, and MWD of 8) was used as the binder resin.

With respect to the complex viscosity, a D Log η*/DT value in the temperature range from fixing temperature −40° C. to fixing temperature −10° C. with respect to the fixing temperature was −0.013, and a D Log η*/DT value in the temperature range from fixing temperature −10° C. to fixing temperature +10° C. with respect to the fixing temperature is 0.013.

Comparative Example 2

A toner was prepared in the same manner as in Example 1, except that 100 parts by weight of a polyester-based resin having an acid value of about 1 (Samyang Co., MH155, THF-insoluble component: 5%, weight average molecular weight of about 200,000, and MWD of 10) was used as the binder resin.

With respect to complex viscosity, a D Log η*/DT value in the temperature range from fixing temperature −40° C. to fixing temperature −10° C. with respect to the fixing temperature was −0.11, and a D Log η*/DT value in the temperature range from fixing temperature −10° C. to fixing temperature +10° C. with respect to the fixing temperature is −0.003. That is, the toner prepared according to Comparative Example 2 had relatively high viscosity and dwell defects occurred.

<Characteristics of Dwell Device>

A dwell device used in experiments had 8.5 mm of Nip, a 190° C. fixing temperature, 170 mm/s linear speed (dwell time 0.05 sec), 32.5 mm outer diameter of a fixing heat roller, and about 10 rad/s of rotation angular velocity.

<Storage Elastic Modulus, Loss Elastic Modulus, and Complex Viscosity Tests>

Samples in a powder phase were directly measured. Such a test method is to precisely measure properties of toners prepared while the applying and removing of a thermal history in a sample manufacturing process is minimized. Viscosity was measured using an ARES apparatus produced by Rheometric Scientific Co. Specifically, viscosity was measured through Dynamic Type Frequency Sweep Test under such conditions as 3% of strain, 10 rad/s of rotational angular velocity, and a Gap Size of about 1 mm.

<Stress Relaxation Test>

The viscosity is a function of temperature and strain with respect to time, and formation of contamination is affected by, in addition to viscosity, viscoelasticity. Fixing conditions are affected by a time transient phenomena. Thus, to define properties of a toner clearly in consideration of these factors described above, a change in an elastic module with respect to the toner dwell time, that is, a stress relaxation was measured.

The stress relaxation test was performed by applying 5% of strain and using a shear elastic rate value at a dwell time as a representative value.

The storage elastic modulus, loss elastic modulus, complex viscosity, loss tangent (tan δ), and stress relaxation at a dwell time of toners prepared according to Examples 1 and 2 and Comparative Examples 1 and 2 were measured. The results are shown in FIGS. 1 through 5.

FIG. 1 is a graph of a storage elastic modulus (G') of a toner according to an embodiment of the present invention. Referring to FIG. 1, the storage elastic moduli of the toners prepared according to Examples 1 and 2 increase above the fixing temperature. That is, below the fixing temperature, elastic properties of the toners were decreased, and then, above the fixing temperature, elastic properties of the toners were increased. On the other hand, the storage elastic moduli of the toners prepared according to Comparative Examples 1 and 2 were decreased above the fixing temperature. That is, elastic properties of the toners prepared according to Comparative Examples 1 and 2 were decreased.

Figure 2:
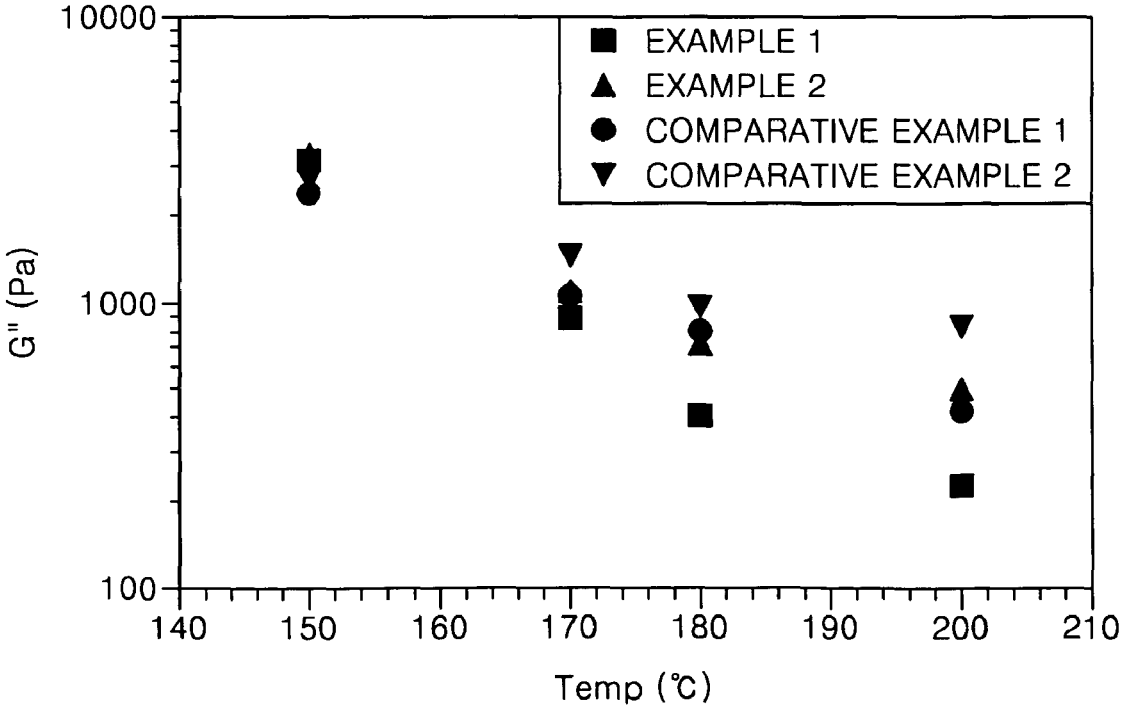
FIG. 2 is a graph of a loss elastic modulus (G") of a toner according to an embodiment of the present invention.

FIG. 2 is a graph of a loss elastic modulus (G") of a toner according to an embodiment of the present invention. Referring to FIG. 2, the loss elastic moduli of the toners prepared according to Examples 1 and 2 and Comparative Examples 1 and 2 were decreased. Since the storage elastic moduli of the toners prepared according to Examples 1 and 2 were increased over time above the fixing temperature as described with reference to FIG. 1, and the loss elastic moduli of the toners prepared according to Examples 1 and 2 were decreased, the loss elastic modulus and the storage elastic modulus interact together so that the complex viscosity of the toner can be maintained constant at high temperature. However, the storage elastic modulus and loss elastic modulus of the toners prepared according to Comparative Examples 1 and 2 were decreased so that the complex viscosity could not be maintained constant at high temperature, which can be identified with reference to FIG. 3.

Figure 3:
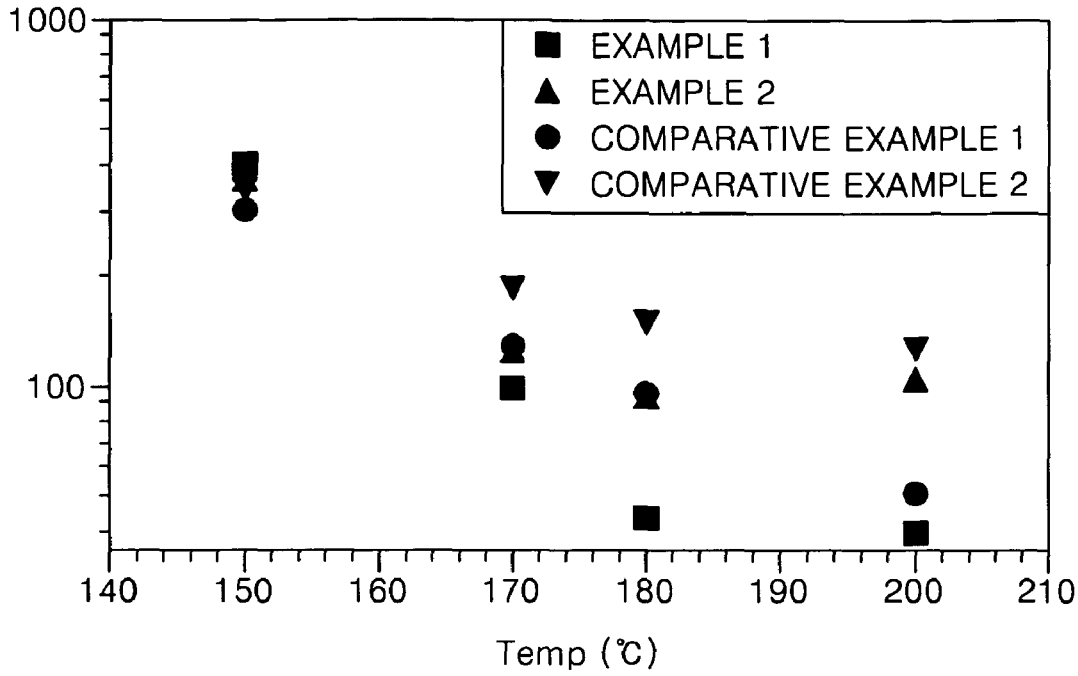
FIG. 3 is a graph of a complex viscosity ($\eta^*$) of a toner according to an embodiment of the present invention.

FIG. 3 is a graph of a complex viscosity (η*) of a toner according to an embodiment of the present invention. Referring to FIG. 3, the complex viscosities of the toners prepared according to Examples 1 and 2 were very unstable with respect to temperature before the fixing temperature, but were stable after the fixing temperature. Accordingly, stable images could be obtained using the toners prepared according to Examples 1 and 2. The absolute value of the complex viscosity of the toner prepared according to Example 1 was the smallest so that the toner can be easily modified when fixed. On the other hand, the viscosity of the toner prepared according to Comparative Example 1 was very dependent on temperature at high temperature, and changed largely below and above the fixing temperature. Such unstable viscosity results in unstable image quality according to fixing conditions, so that contamination occurs and it is difficult to obtain a stable image quality. The toner prepared according to Comparative Example 2 has stable viscosity at high temperature, but the absolute value of the viscosity is too high.

Figure 4:
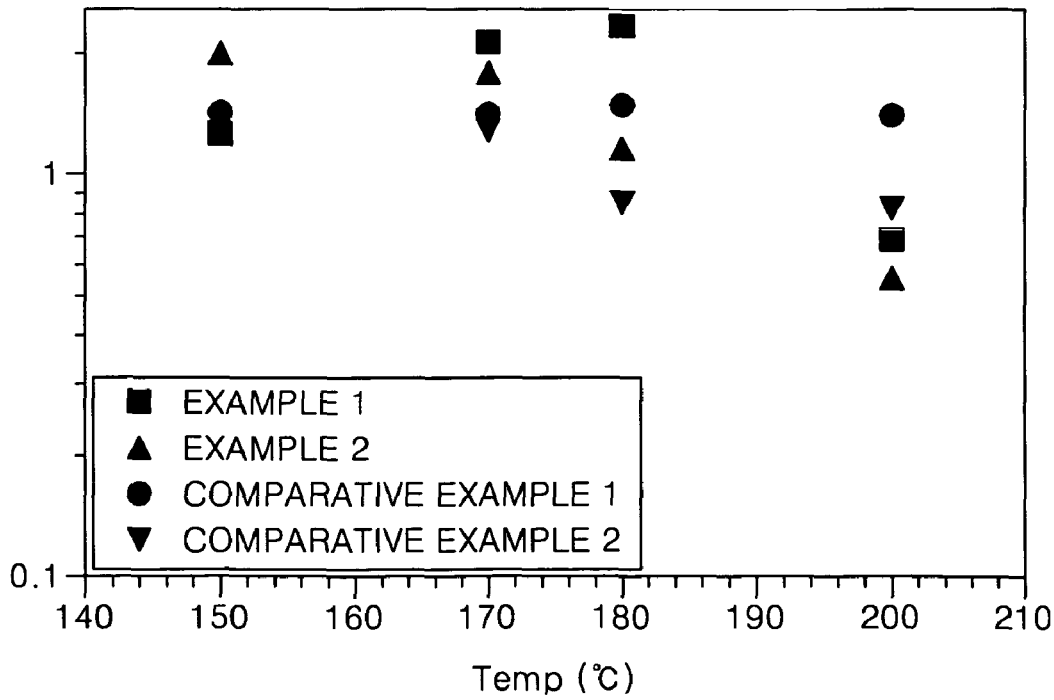
FIG. 4 is a graph of a loss tangent (tan $\delta$) of a toner according to an embodiment of the present invention.

FIG. 4 is a graph of a loss tangent (tan δ) of a toner according to an embodiment of the present invention. Referring to FIG. 4, the loss tangents of the toners prepared according to Examples 1 and 2 were increased below the fixing temperature, and above the fixing temperature, the loss tangents of the toners prepared according to Examples 1 and 2 were decreased. When the loss tangent (tan δ) is increased, the toner obtains a plasticizing property required for the fixing, on the other hand, when the loss tangent is decreased, the toner obtains an elastic property. When the toner obtains an elastic property at high temperature, the toner can be easily separated from a dwell roll, thereby preventing contamination. On the other hand, the tan δ of the toner prepared according to Comparative Example 1 was not changed above the fixing temperature. As for the toner prepared according to Comparative Example 2, the toner had sufficient tan δ below the fixing temperature, but above the fixing temperature, the tan δ of the toner was decreased.

Figure 5:
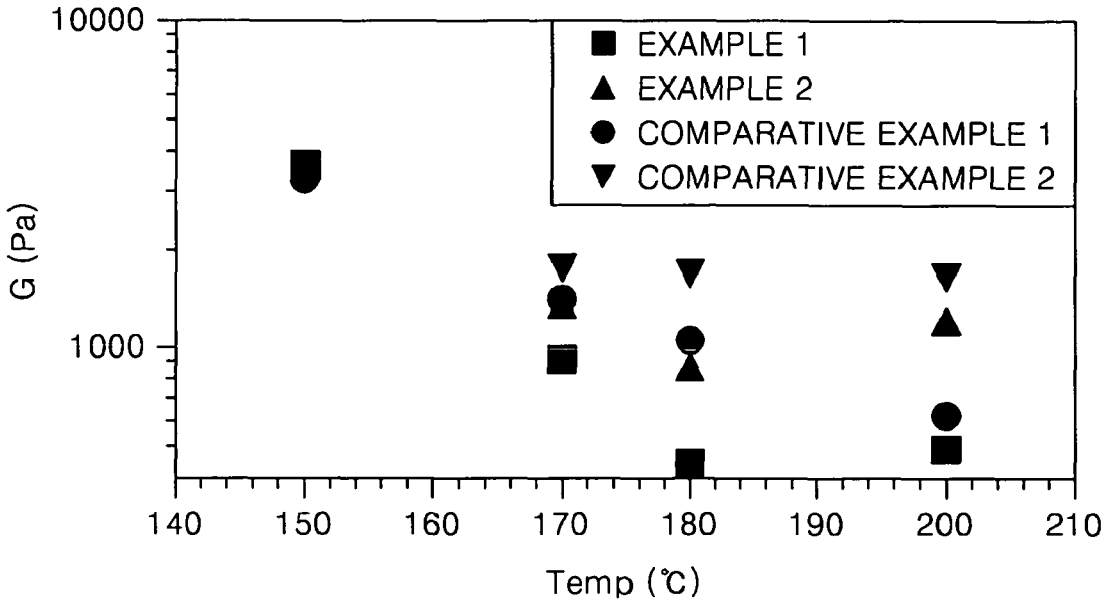
FIG. 5 is a graph of a stress relaxation (G) of a toner according to an embodiment of the present invention.

FIG. 5 is a graph of a stress relaxation (G) of a toner according to an embodiment of the present invention. Referring to FIG. 5, the stress relaxations of the toners prepared according to Examples 1 and 2 at a dwell time was in the range from 300 to 1,000 Pa·s, and thus the toners showed excellent fixing properties and caused less contamination. Specifically, the toner prepared according to Example 1 has smallest elasticity, that is, the toner may be quickly changed according to a given force and time. On the other hand, stress relaxations of the toners prepared according to Comparative Examples 1 and 2 were more than 1,000 Pa and thus dwell defects occurred.

A toner according to the present invention has excellent fixing properties so that the quality of an image according to fixing conditions can be stabilized and causes less contamination.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A toner for electrophotography comprising a binder resin, a coloring agent, a charge controlling agent, and a releasing agent, wherein the toner has a D Log η*/DT absolute value of 0.02 or more, between a temperature of 40° C. lower than the fixing temperature of the toner and a temperature of 10° C. below the fixing temperature of the toner, and the toner has a D Log η*/DT absolute value of 0.005 or less between a temperature of 10° C. below the fixing temperature and a temperature of 10° C. or higher than the fixing temperature of the toner, where η* is the complex viscosity (η*) of the toner at a fixing temperature and an angular velocity of the fixing heat roller is in the range from $5.0\times10^{1}$ Pa·s to $1.0\times10^{2}$ Pa·s and where D is a differential and T is the temperature.

2. The toner of claim 1, wherein the angular velocity of the fixing heat roller is in the range from 5 to 10 rad/s.

3. The toner of claim 1, wherein a stress relaxation of the toner at a temperature 10° C. lower than the fixing temperature of the toner is in the range from about 300 to 1,000 Pa·s.

4. The toner of claim 1, wherein an activation energy of the toner is in the range from about 20 to 80 KJ/mol.

5. The toner of claim 1, wherein a loss tangent (tan) δ obtained by dividing a loss elastic modulus with a storage elastic modulus at a temperature 20° C. lower than the fixing temperature to the fixing temperature is less than 1.

6. The toner of claim 1, wherein the toner has a D Log η*/DT absolute value in the range from about 0.02 to 0.05 between a temperature of 40° C. lower than the fixing temperature of the toner and a temperature of 10° C. below the fixing temperature of the toner.

7. The toner of claim 1, wherein the toner has a D Log η*/DT absolute value is in the range from about 0.001 to 0.005 between a temperature of 10° C. below the fixing temperature and a temperature of 10° C. or higher than the fixing temperature of the toner.

8. A method of forming an image comprising: forming a visible image by attaching a toner to the surface of a photoreceptor on which an electrostatic image is formed and transferring the visible image to a transfer material, wherein the toner is the toner of claim 1.

9. An imaging apparatus for forming an image comprising:

an organic photoreceptor;

a unit charging a surface of the organic photoreceptor;

a unit forming an electrostatic latent image on a surface of the organic photoreceptor;

a unit containing toner;

a unit supplying the toner to the surface of the organic photoreceptor to develop the electrostatic latent image on the surface of the organic photoreceptor into a toner image; and a unit transferring the toner image from the surface of the organic photoreceptor onto a transfer medium, wherein the toner is a toner for electrophotography according to claim 1.

* * * * *